US012203227B2

(12) United States Patent
Heim et al.

(10) Patent No.: US 12,203,227 B2
(45) Date of Patent: Jan. 21, 2025

(54) METHOD AND ARRANGEMENT FOR DISLODGING A FLOATING GROUND GUARD OF A ROTARY MIXER

(71) Applicant: Caterpillar Paving Products Inc., Brooklyn Park, MN (US)

(72) Inventors: Daniel J. Heim, Blaine, MN (US); Todd R. Dunsmoor, Andover, MN (US); Paul J. Koenen, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 182 days.

(21) Appl. No.: 17/948,445

(22) Filed: Sep. 20, 2022

(65) Prior Publication Data

US 2024/0093441 A1 Mar. 21, 2024

(51) Int. Cl.
*E01C 23/088* (2006.01)

(52) U.S. Cl.
CPC ..... *E01C 23/088* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 4,322,178 | A | 3/1982 | Lee | |
| 5,382,084 | A | 1/1995 | Diver et al. | |
| 7,370,916 | B2 | 5/2008 | Ley et al. | |
| 10,640,932 | B2 | 5/2020 | Hogan et al. | |
| 10,876,260 | B2 | 12/2020 | Muir et al. | |
| 10,975,535 | B2 | 4/2021 | Hogan et al. | |
| 11,225,761 | B2 | 1/2022 | Doy et al. | |
| 11,408,136 | B1 * | 8/2022 | Frantz | E01C 23/127 |
| 2007/0284933 | A1 * | 12/2007 | Rotz | E01C 23/088 299/39.4 |
| 2013/0082508 | A1 * | 4/2013 | Orefice | E01C 23/088 299/10 |
| 2019/0161924 | A1 * | 5/2019 | Gerhardy | E01C 23/127 |
| 2022/0042256 | A1 | 2/2022 | Ponstein et al. | |

* cited by examiner

*Primary Examiner* — Janine M Kreck

(57) ABSTRACT

In a rotary mixer having a floating ground guard mounted for vertical movement relative to the frame and relative to the rotor, an actuator configured to provide movement in at least a vertical plane relative to the frame, and a ground guard dislodging tool coupled to the floating ground guard. The ground guard dislodging tool and the actuator are disposed such that the actuator engages and exerts a force on the ground guard dislodging tool to move the floating ground guard in a downward direction relative to the frame.

14 Claims, 9 Drawing Sheets

METHOD AND ARRANGEMENT FOR DISLODGING A FLOATING GROUND GUARD OF A ROTARY MIXER

TECHNICAL FIELD

This patent disclosure relates generally to maintenance of rotary mixers, and, more particularly to tools and methods of servicing the floating ground guard on a rotary mixer.

BACKGROUND

Various machines or implements may include ground engaging tools for interacting, treating, or modifying the ground as the machine or implement travels. In the construction industry, such machines or equipment may include earth movers or cold planers, rotary mixers, or other milling machines, for example.

Machines such as rotary mixers and cold planers utilize a spinning rotor in the form of a drum with cutting elements or teeth to remove or grind a road surface. A floating skate or ground guard may ride along the road surface. In a cold planer, a housing and ground guard are designed to facilitate removal of the ground material; in a rotary mixer, the housing and ground guard are design to cause a mixing of the removed material and redistribution back toward the ground.

That is, rotary mixers may be utilized in rehabilitation of roads or other pavement to reclaim the pavement and base materials to serve as the basis for repavement. In-place full depth reclamation is growing in use as the worldwide supply of high quality aggregate becomes more scarce and increasingly expensive to haul. Reclamation may offer a cost-effective means to recycle the material that is already in place without the time and expense of removing and replacing it. Existing pavements are pulverized in place along with a portion of the existing base materials to form a new homogenous base. Reclamation may allow the contractor to not only reuse the materials at hand, but it also provide the opportunity to introduce water or emulsions, and other virgin aggregates to improve the material design. Compared with the costs of other rehabilitation methods—overlay or reconstruction— reclamation may be an economical choice over the life of the rehabilitated road.

The sharp teeth of the rotor pulverize road materials including the pavement and base materials, mixing the pulverized material as it is lifted when at least a portion the pulverized materials rotating with the rotor. The pulverized material is guided by a rotor housing and floating ground guards to be relaid. Occasionally, however, the floating ground guards may be plugged or bound up with debris, causing the floating ground guard to seize in up position. When seized in up position, pulverized material and the spinning rotor may be exposed in certain circumstances. Lowering the seized floating ground guard is a labor intensive, manual process, however.

U.S. Pat. No. 10,640,932 to Hogan et al. discloses a spray system for a cold planer machine, which likewise utilizes a spinning rotor and a skid arrangement. The Hogan patent teaches the placement of a spraying bank disclosed inside the housing and arranged to spray fluid directed at the rotor.

SUMMARY

The disclosure describes, in one aspect, a rotary mixer including a frame supported above a surface of a ground by a ground-engaging portion and a suspension, a rotor supported by the frame and configured for working the ground, and a rotor housing assembly including a floating ground guard. The floating ground guard is mounted for vertical movement relative to the frame and relative to the rotor. The rotary mixer further includes an actuator configured to provide movement in at least a vertical plane relative to the frame, and a ground guard dislodging tool coupled to the floating ground guard. The ground guard dislodging tool and the actuator are disposed such that the actuator engages and exerts a force on the ground guard dislodging tool to move the floating ground guard in a downward direction relative to the frame.

The disclosure describes, in another aspect, a tool for freeing a bound ground-engaging member of a milling machine, the milling machine having an actuator. The tool includes an elongate body and a stabilizer. The elongate body has a first contact surface and a second contact surface, and is shaped to extend between a portion of the ground engaging member and a portion of the actuator. The first contact surface is arranged to oppose the portion of the ground engaging member during use, and the second contact surface arranged to oppose the portion of the actuator during use. The stabilizer is adjacent to the first contact surface.

The disclosure describes, in yet another aspect, a method of dislodging a floating ground guard of a rotary mixer that includes a frame supported above a surface of a ground by a ground-engaging portion, a rotor supported by the frame and configured for working the ground, and a rotor housing assembly including the floating ground guard. The floating ground guard is slidably mounted for vertical movement relative to the frame and relative to the rotor. The method includes coupling a ground guard dislodging tool to the floating ground guard, the ground guard dislodging tool including an arcuate upper surface, causing an actuator to move into engagement with the arcuate upper surface of the ground guard dislodging tool, and continuing to advance the actuator in at least a vertical plane to exert a dislodging force on the ground guard dislodging tool to move the floating ground guard in a downward direction relative to the frame.

BRIEF DESCRIPTION OF THE DRAWING(S)

DETAILED DESCRIPTION

Figure 1:
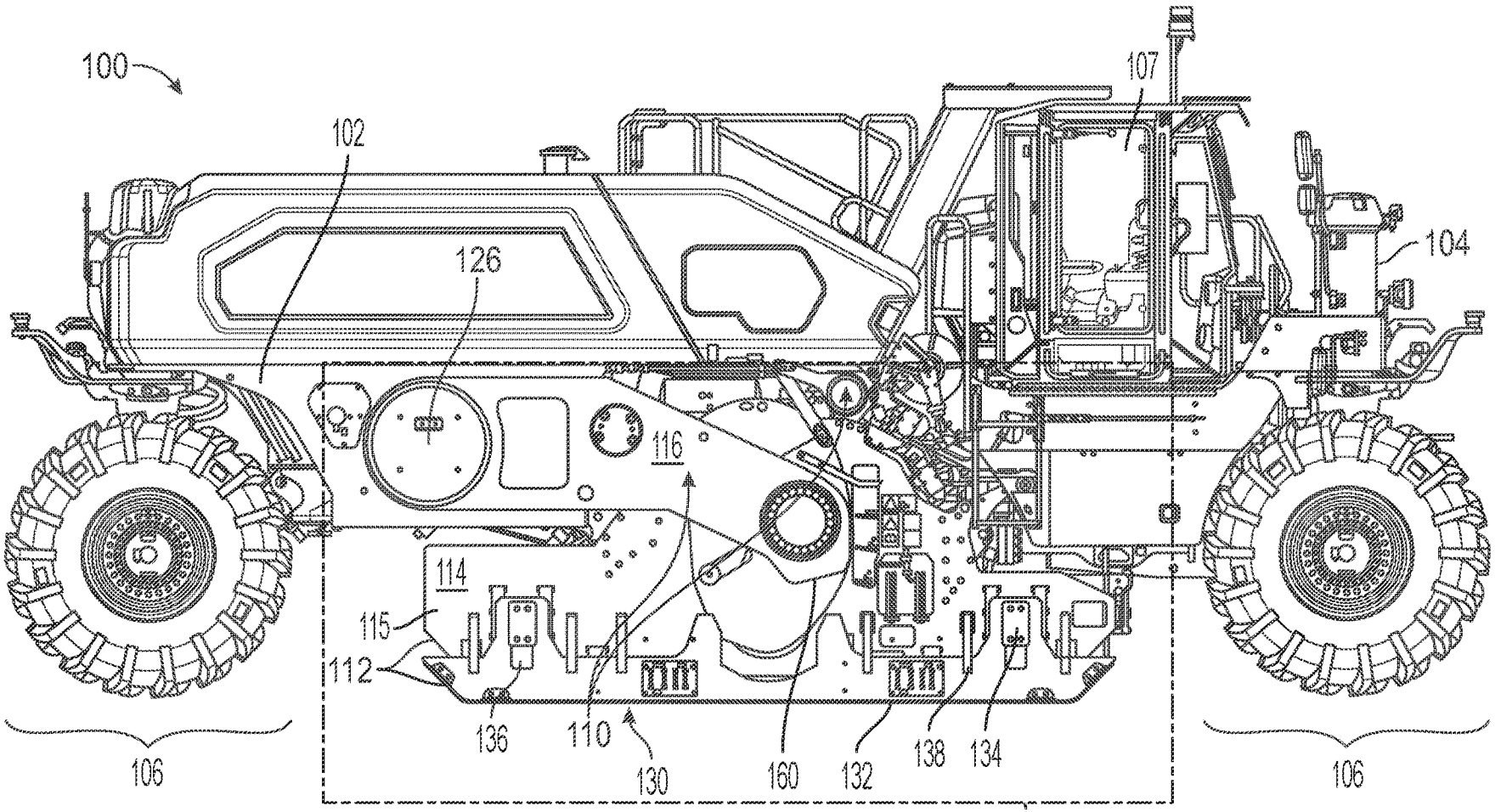
FIG. 1 is a side elevational view of a rotary mixer on which a tool may be utilized in accordance with one or more embodiments.

This disclosure relates to rotary mixers, and more specifically, to tools, systems, and methods for lowering floating ground guards on rotary mixers to facilitate removal of debris. Referring now to FIG. 1, an exemplary rotary mixer 100 is shown. The rotary mixer 100 may be adapted to cut and/or process a top layer of the ground such as an existing roadway or a new or existing roadway bed, and base materials. In particular, the rotary mixer 100 may be adapted to cut and/or process layers of dirt, gravel, pavement, or other soil, and base materials, depending upon the depth of the cut. The cutting/processing may involve tearing the desired layer up, mixing it, and laying it back down in a more homogenous arrangement allowing the surface to be compacted and pavement to be placed thereon.

Figure 2:
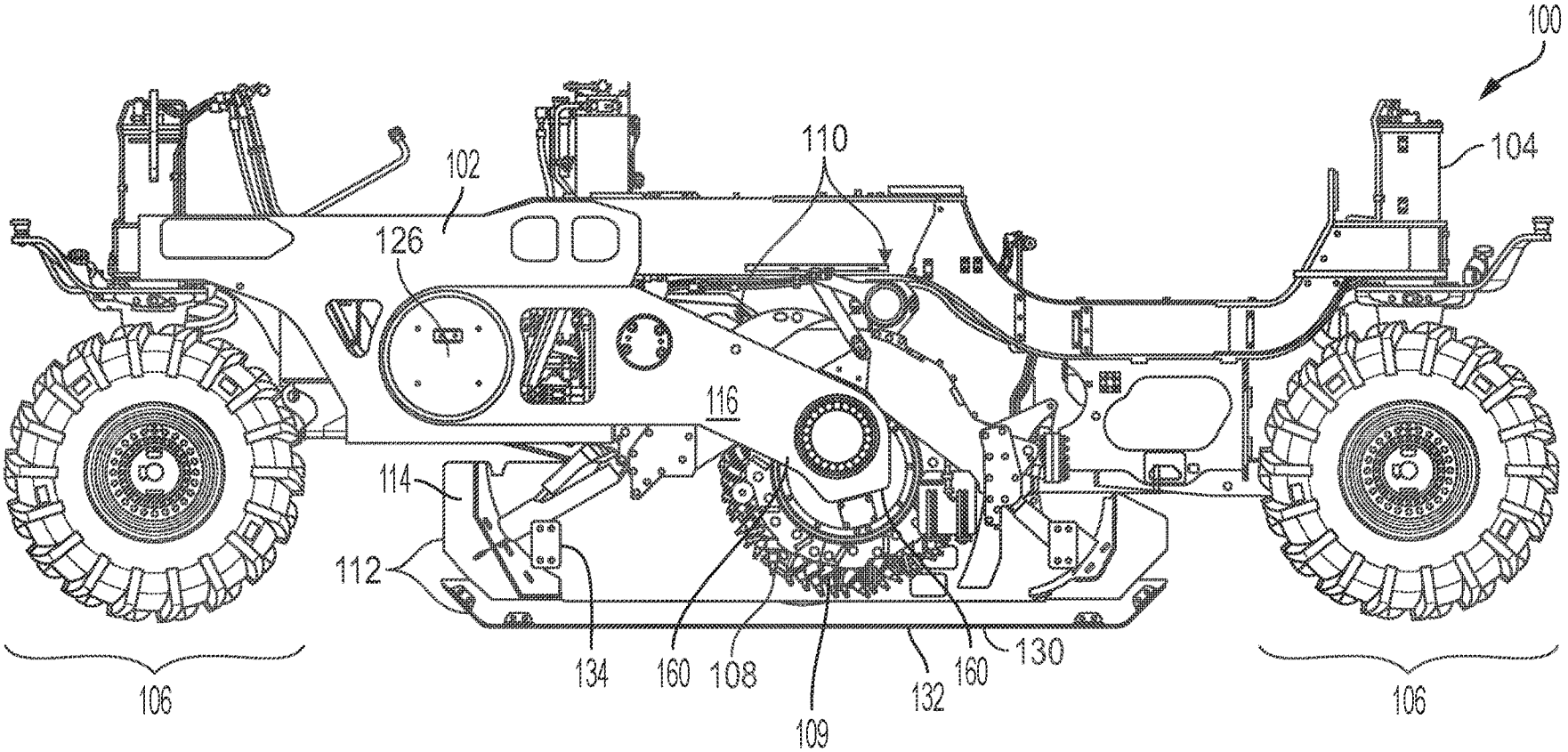
FIG. 2 is a side view of the frame and rotor portion of FIG. 1 with a side of the rotor housing removed.

The rotary mixer 100 may include a frame 102 supported by a suspension 104 on ground-engaging elements 106. Although shown as wheels, the ground engaging elements 106 can be any kind of ground-engaging device that allows rotary mixer 100 to move over a surface within a working area, such as, for example, tracks. The rotary mixer 100 may be motivated by any appropriate power source, such as an engine and transmission, a hydraulic drive system, or one or more batteries (not visible in FIGS. 1 and 2). Further, the rotary mixer 100 may be operated by any appropriate arrangement, such as an operator (not shown), who may be carried in a supported cabin 107. At least some embodiments may be operated by remotely from a control center or the like (not illustrated).

A rotor 108 (see FIG. 2) may be suspended from the frame 102 and may be adapted to cut, mix, or otherwise process a top layer of material arranged beneath the rotary mixer 100. The rotor 108 may include a generally cylindrical can or drum arranged with an axis extending generally widthwise across the machine, between the front and rear ground-engaging portions 106, and below the frame 102. The rotor 108 may include teeth, blades, spurs, or other cutting elements 109 arranged on a surface or other outward facing portion of the can or drum. The cutting elements 109 may be particularly adapted to cut, shave, and mix material below the mixer. The cutting elements 109 may be particularly well suited for cutting, shaving, and/or mixing existing pavements, soil, gravel, rock, or other relatively hard surfaces. While the can or drum may be arranged on an axle or other spindle adapted for support at each end and also adapted for powered rotation of the rotor 108, in one or more embodiments, the rotor 108 may be supported from a single end and/or at one or more points along its length such as in the middle, for example.

The rotor 108 may be coupled to the frame 102 by a rotor support system 110 that may include, for example, a rotor arm 116 that may be pivotably coupled to the frame 102 and axially support the rotor 108. Rotation may be imparted to the rotor 108 by any appropriate arrangement, such as, for example, a rotor belt (not visible). In at least one embodiment, the rotor belt may be encased by a rotor belt casing, which may be, for example a rotor arm 116, such as is illustrated. The rotor arm 116 of the illustrated embodiment may pivot to adjust the position of the rotor 108 relative to a lower surface. A second rotor arm can be provided on the opposite side of the rotary mixer 100, which is not visible in FIGS. 1 and 2.

Due to the aggressive interaction between the rotor 108 and the ground, particles or debris may fly from the rotor 108 and may not be contained as desired. This flying debris may also be a hazard to workers or personnel operating the machine. Accordingly, a rotor housing assembly 112 may be provided to contain the debris and allow the debris to be maintained at or around the rotor 108 to allow for further mixing. The rotor housing assembly 112 may include a rotor housing 114 including at least one downwardly extending plate 115 that may assist in the containment of ground, particles, or debris around the rotor 108 on the front, rear, and sides of the rotor 108. The rotor housing assembly 112 may be coupled to the rotary mixer 100 by any appropriate arrangement. In one or more embodiments, the rotor housing assembly 112 may surround the rotor 108 as mentioned, and may be supported by the frame 102. In one or more embodiments, the rotor housing assembly 112 may be supported by the rotor support system 110 so as to move with the rotor 108 as the rotor 108 is adjusted upward and downward relative to the frame 102.

The rotor housing assembly 112 may also include a ground-engaging member such as a floating ground guard 130 adapted to generally continuously engage the ground so as to seal off the working area of the rotor 108. The floating ground guard 130 may, for example, be arranged like one or more downwardly extending plate portions at either end of the rotor 108, or a skirt on a bottom edge of the rotor housing 112. The floating ground guard 130 may include flanges or skis 132 on a bottom edge thereof that engage the ground and support the floating ground guard 130 relative to the ground. While an alternate angle may be provided, the flanges or skis 132 may extend at a right angle to the downwardly extending plates.

The floating ground guard 130 may be slidably supported by the rotor housing 114, such that the floating ground guard 130 may move up and down relative to the rotor housing 114 substantially independently of the rotor housing position. For example, as shown in FIG. 1, the floating ground guard 130 may be secured to the rotor housing 114 with a bar (not shown) extending outward to a cleat or plate 134. The floating ground guard 130 may include a sliding slot 136 for slidably engaging the bar and allowing the floating ground guard 130 to articulate upward and downward as the rotor housing 114 gets closer to and further away from the ground respectively. The movement of the floating ground guard 130 relative to the rotor housing 114 may further be governed by one or more stationary cleats or arms 138 that extend downward from the rotor housing 114, such that the arms 138 inhibit outward movement of the floating ground guard 130 relative to the rotor housing 114. In this way, so long as the achievable range of vertical motion of the floating ground guard 130 is not exceeded, the floating ground guard 130 helps to ensure that generally continuous contact of a portion of the rotor housing assembly 112 with the ground is made to seal working area of the rotor 108.

There are occasions, however, when portions of the chamber formed by the rotor housing 114 and the floating ground guard 130 may become overloaded with debris, which may cause the floating ground guard 130 to seize relative to the rotor housing 114, generally in an upward position. The seized floating ground guard 130 is thus unable to descend fully under the influence of gravity and conform to the work surface over which it passes. This disclosure provides a ground guard dislodging tool for assisting in lowering of the floating ground guard 130 relative to the rotor housing 114 by overcoming the seizing effect of the debris, and a method utilizing such a ground guard dislodging tool in lowering the floating ground guard 130 relative to the rotor housing 114.

Figure 3:
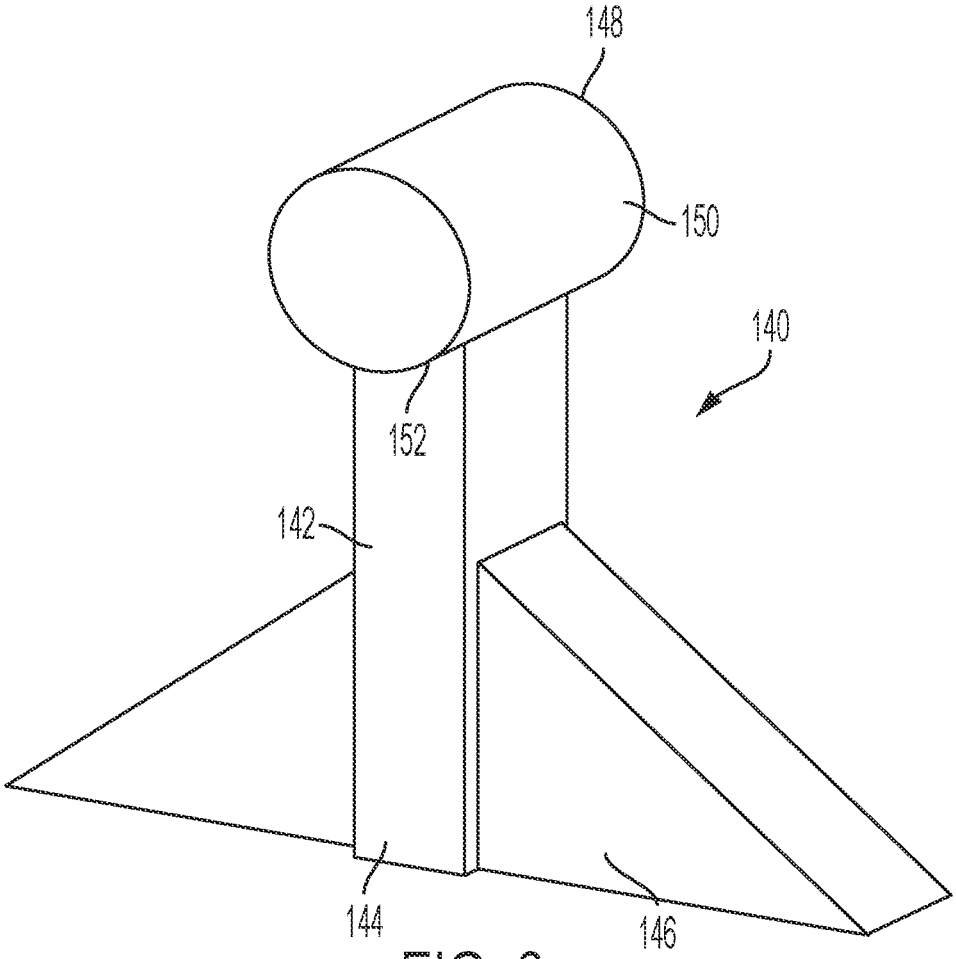
FIG. 3 is an isometric view of a tool according to an embodiment of this disclosure.
Figure 4:
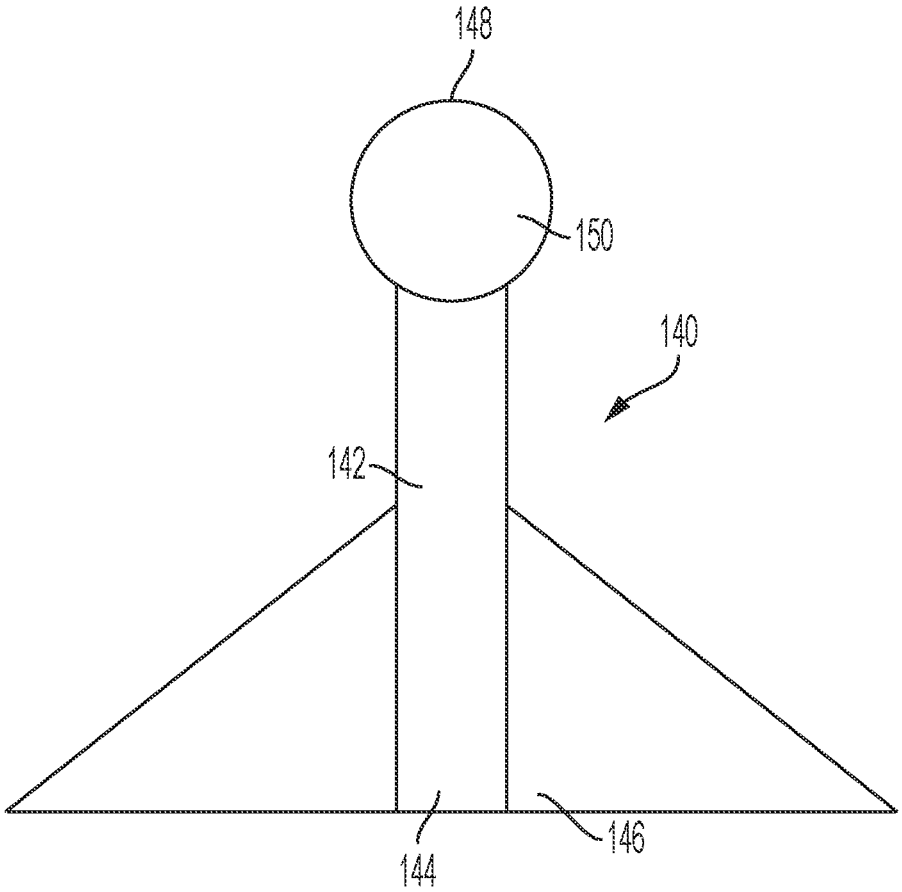
FIG. 4 is a front elevational view of the tool of FIG. 3.
Figure 5:
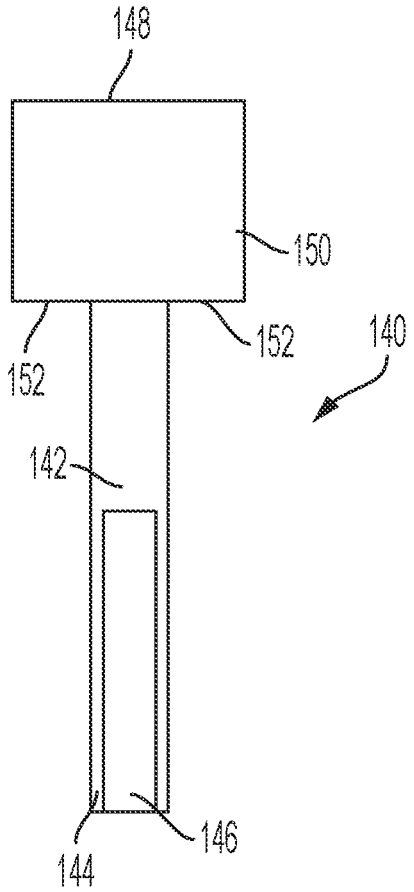
FIG. 5 is a side elevational view of the tool of FIGS. 3 and 4.

Turning to FIG. 3, there is provided a ground guard dislodging tool 140 for use in lowering a floating ground guard 130 from a rotor housing 114. The ground guard dislodging tool 140 includes a generally vertical support 142 may be an elongate body with a base portion 144 that presents a first contact surface 145 that may be positioned against the ski 132 of the floating ground guard 130. In the illustrated embodiment, the base portion 144 further includes one or more stabilizers or braces 146 that extend to either side. The stabilizers or braces 146 may be disposed adjacent the first contact surface 145 such that the stabilizers or braces 146 present a further surface disposed in the same plane as the first contact surface 145, which may be broken or continuous. In this way, a force exerted on the ski 132 of the floating ground guard 130 may be distributed along a greater area of the ski 132. That is, the first contact surface 145 opposes a portion of the floating ground guard 130 during use.

In order to dislodge the floating ground guard 130, the ground guard dislodging tool 140 includes a second contact surface that may include an arcuate upper surface 148. In the illustrated embodiment, the arcuate upper surface 148 is provided by a transversely extending cylindrical structure 150. It will be appreciated from this disclosure, however, that the arcuate upper surface 148 may be of an alternative design. For example, the generally vertical support 142 may include an arcuate upper surface.

In at least one embodiment, the arcuate upper surface 148 of the cylindrical structure 150 may extend transversely from the generally vertical support 142 (see transverse extensions 152). That is, the arc of the arcuate upper surface 148 may extend into one or more planes that are disposed parallel to a plane including the generally vertical support 142 and stabilizers or braces 146, such that a portion of the arcuate upper surface 148 is offset from the generally vertical support 142 and stabilizers or braces 146 or at least a portion of the arcuate upper surface 148 may be offset from the remainder of the generally vertical support 142. In this way, the arcuate upper surface 148 provides additional area for exertion of a dislodging force on the ground guard dislodging tool 140.

The ground guard dislodging tool 140 may be formed by any appropriate method of any appropriate material that will withstand a dislodging force exerted on the ground guard dislodging tool 140. By way of example only, the ground guard dislodging tool 140 may be cast, forged, or machined. The ground guard dislodging tool 140 may be formed of steel, iron or other material, for example. Moreover, the ground guard dislodging tool 140 may be formed as a unitary structure, or may be formed in multiple pieces that are then secured together by any appropriate method, such as, for example, welding, or other coupling arrangement.

Figure 6:
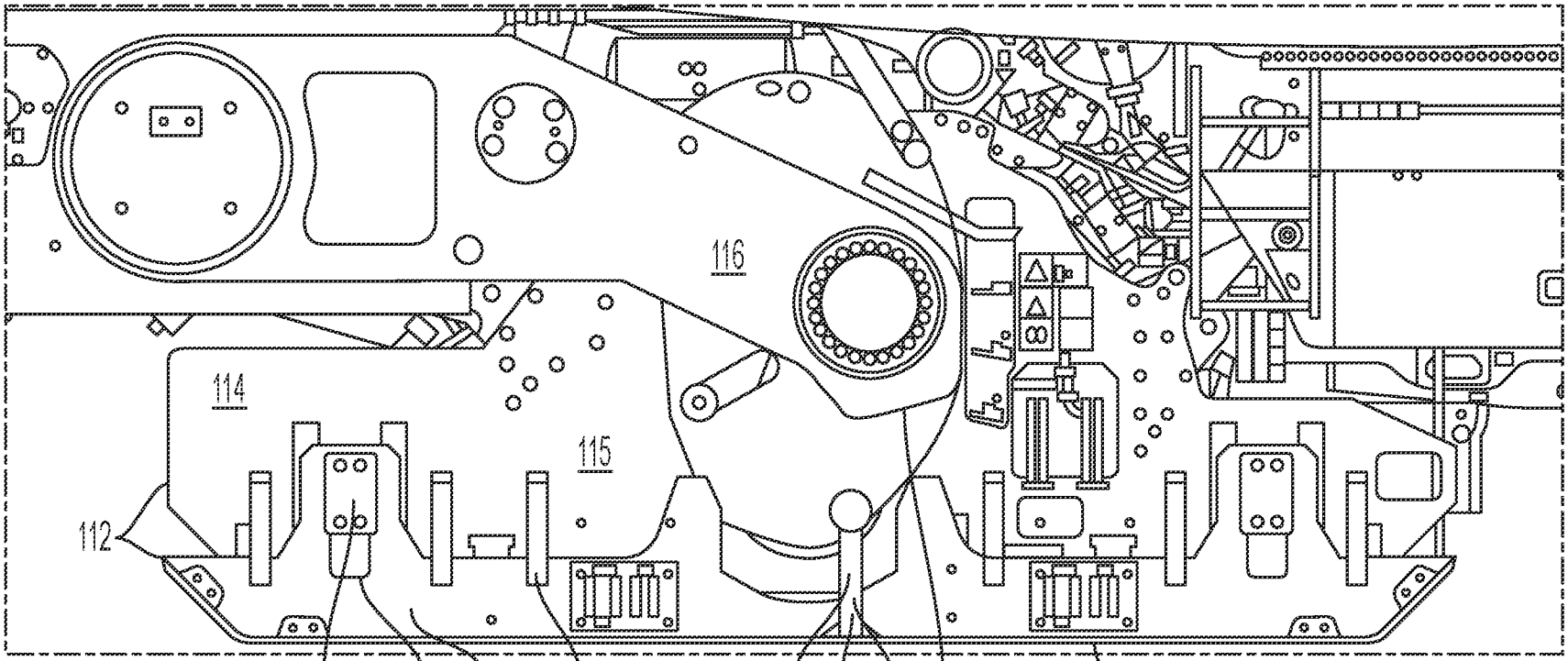
FIG. 6 is a side elevational view of the tool of FIGS. 3-5 in an operable position on a floating ground guard of the rotary mixer of FIGS. 1-2.
Figure 7:
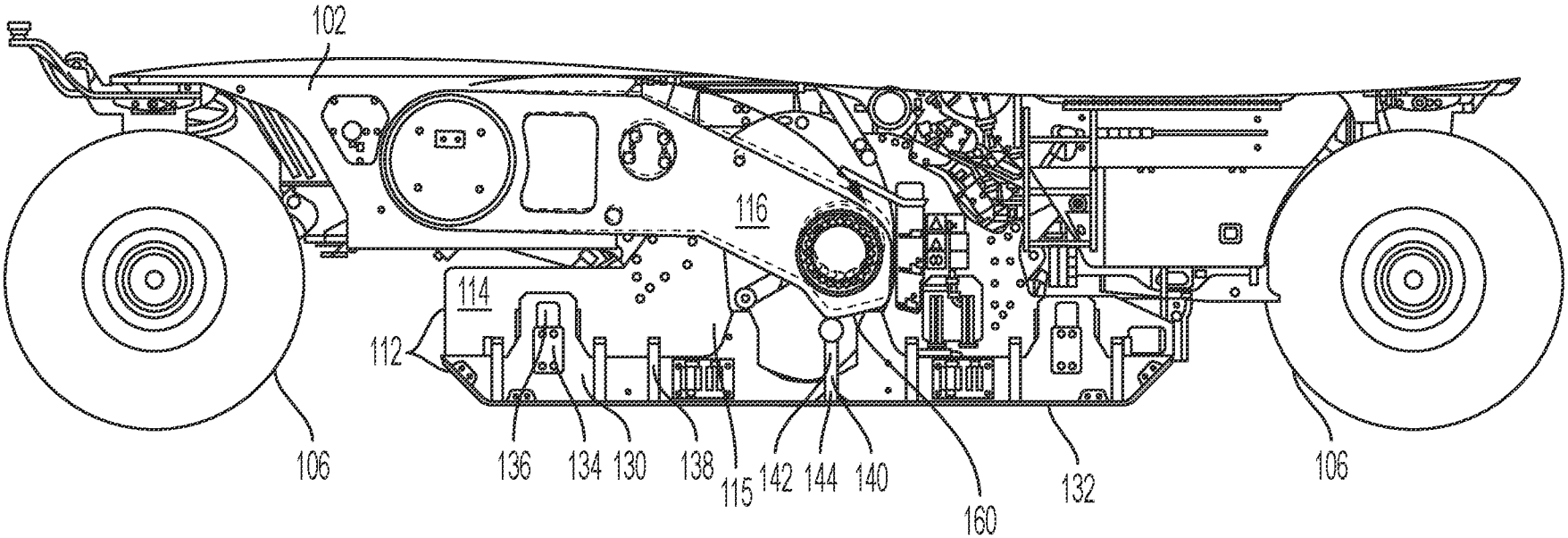
FIGS. 7 and 8 are fragmentary side elevational views of the rotary mixer of FIGS. 1 and 2 with the tool of FIGS. 3-5 in an operable position during stages of operation.
Figure 8:
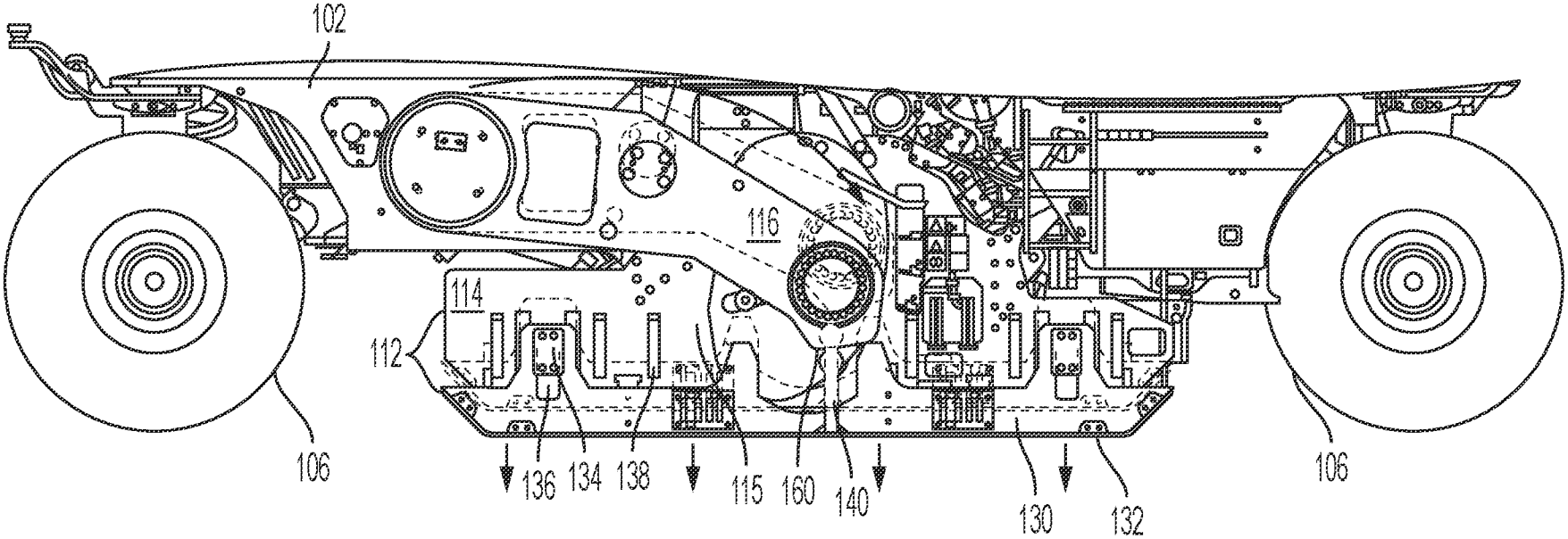

Referring to FIGS. 6-8, the ground guard dislodging tool 140 may be mounted to the floating ground guard 130 by any appropriate arrangement. For example, the ground guard dislodging tool 140 may be welded to the floating ground guard 130. By way of further example, the ground guard dislodging tool 140 may be coupled to the floating ground guard 130 with at least one bracket and/or at least one fastener, such as one or more bolts or the like. Alternatively, the ground guard dislodging tool could be coupled to the floating ground guard 130 only by placing braces 146 on the ski 132 of the floating ground guard, without any permanent mechanical coupling therebetween.

An arrangement for dislodging the floating ground guard 130 further includes an actuator 160. While the actuator may be of any appropriate design to exert a generally downward force on the arcuate upper surface 148 of the ground guard dislodging tool 140, in the illustrated embodiment, the actuator 160 may be a portion of the rotary mixer 100 associated with the support system 110 of the rotor 108, for example. In the illustrated embodiment, the actuator 160 may be the rotor arm 116. In this way, when the rotor arm 116 is pivoted downward, a portion of the rotor arm 116 may confront and ride along the arcuate upper surface 148 of the ground guard dislodging tool 140. Those of skill in the art will appreciate that it may be a portion of the housing associated with the rotor arm 116 surrounding a rotary belt for example, that may physically confront the arcuate upper surface 148. As the rotor arm 116 continues to move downward, it exerts a downward force on the ground guard dislodging tool 140, and, accordingly, the floating ground guard 130. This downward force may dislodge the seized floating ground guard 130, freeing it to move downward relative to the rotor housing 114. This separation may allow further cleaning of binding debris, if desired or necessary.

Figure 9:
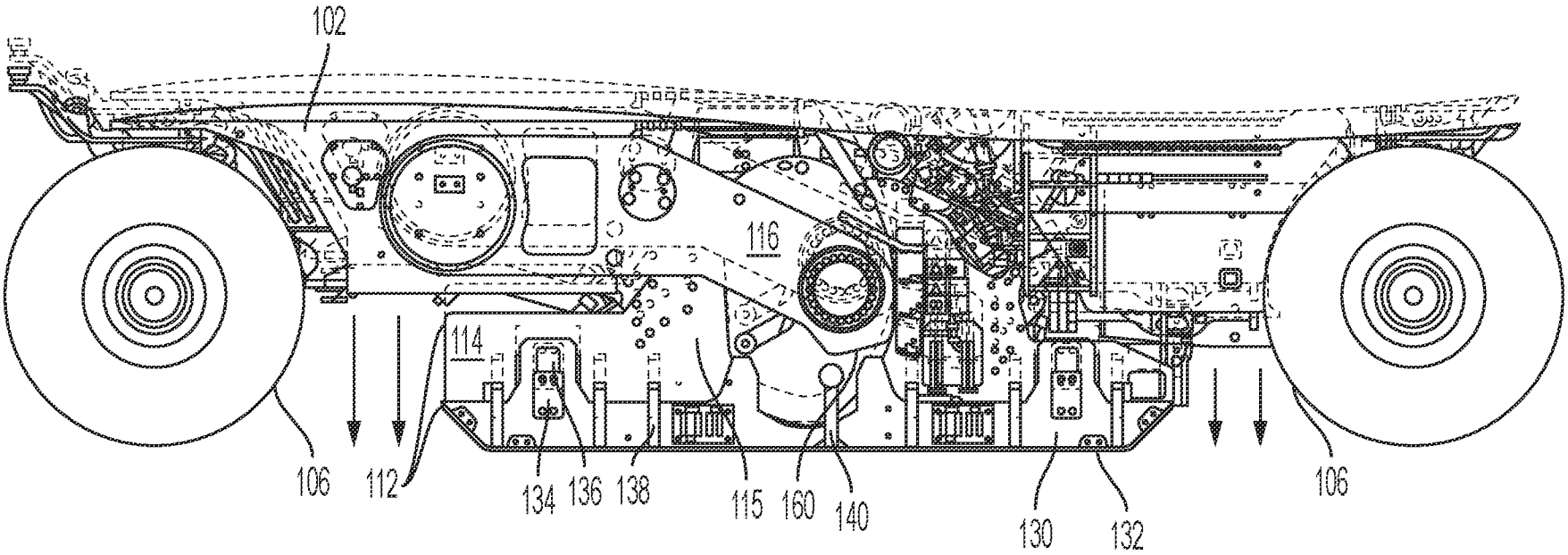
FIG. 9 is a fragmentary side elevational view of the rotary mixer of FIGS. 1 and 2 with the tool of FIGS. 3-5 in an operable position wherein the floating ground guard is moved to an upward position.

Thus, in a method according to this disclosure, the ground guard dislodging tool 140 may be coupled to the floating ground guard 130 by any appropriate arrangement, such as welding, and/or one or more fasteners and/or brackets. The actuator 160 is then caused to move into engagement with the arcuate upper surface 148 of the ground guard dislodging tool 140. The actuator 160 continues advancing in at least a vertical plane to exert a dislodging force on the ground guard dislodging tool 140 to move the floating ground guard 130 in a downward direction relative to the frame 102. Referring to FIG. 9, if desired, the floating ground guard 130 may be again moved up into position on the rotor housing 114 by causing the suspension 104 to lower the frame 102 of the rotary mixer 100, thereby lowering the rotor housing 114 to engage the floating ground guard 130.

INDUSTRIAL APPLICABILITY

The present disclosure is applicable to rotary mixers 100 and other machines that include a floating ground guard 130. The ground guard dislodging tool 140 together with the actuator 160, and the method of dislodging a seized floating ground guard 130, may facilitate cleaning of portions of the rotor housing 114 and the floating ground guard 130. In at least some embodiments, this may minimize the labor associated with such dislodging.

An example embodiment can be a tool for freeing a bound ground-engaging member of a milling machine, the milling machine having an actuator. Such a tool has an elongate body with first and second contact surfaces. The elongate body can be shaped to extend between a portion of the ground engaging member and a portion of the actuator, the first contact surface arranged to oppose the portion of the ground engaging member during use, and the second contact surface arranged to oppose the portion of the actuator during use. The tool also can have a stabilizer adjacent to the first contact surface, adjacent meaning a portion of the stabilizer is arranged to make contact with the portion of the ground engaging member as the bound ground-engaging member is freed.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A rotary mixer comprising:

a frame supported above a surface of a ground by a ground-engaging portion and a suspension;

a rotor supported by the frame and configured for working the ground;

a rotor housing assembly including a floating ground guard, the floating ground guard being slidably mounted for vertical movement relative to the frame and relative to the rotor;

an actuator, the actuator being configured to provide movement in at least a vertical plane relative to the frame; and a ground guard dislodging tool coupled to the floating ground guard;

wherein the ground guard dislodging tool and the actuator are disposed such that the actuator engages and exerts a force on the ground guard dislodging tool to move the floating ground guard in a downward direction relative to the frame.

2. The rotary mixer of claim 1 wherein the rotor housing assembly further includes at least a downwardly extending plate, the downwardly extending plate being coupled with the frame, and wherein the floating ground guard is slidably mounted with the downwardly extending plate.

3. The rotary mixer of claim 1 wherein the floating ground guard is configured to ride along the ground during operation of the rotary mixer.

4. The rotary mixer of claim 1 wherein the ground guard dislodging tool includes an arcuate upper surface.

5. The rotary mixer of claim 1 wherein the actuator includes at least a portion of a rotor support system.

6. The rotary mixer of claim 5 wherein the rotor support system includes a rotor arm, the rotor arm axially supporting the rotor, the actuator including the rotor arm.

7. The rotary mixer of claim 6 wherein the rotor arm is pivotably coupled to the frame, the rotor arm being pivotable downward to engage the ground guard dislodging tool.

8. The rotary mixer of claim 1 wherein the ground guard dislodging tool is coupled to the floating ground guard by at least one of at least one weld, a bracket, and a fastener.

9. The rotary mixer of claim 1 wherein the floating ground guard includes a generally vertical plate and at least one ski extending at substantially a right angle to the vertical plate, the ground guard dislodging tool engaging the at least one ski.

10. A method of dislodging a floating ground guard of a rotary mixer, the rotary mixer including a frame supported above a surface of a ground by a ground-engaging portion, a rotor supported by the frame and configured for working the ground, and a rotor housing assembly including the floating ground guard, the floating ground guard being slidably mounted for vertical movement relative to the frame and relative to the rotor, the method comprising:

coupling a ground guard dislodging tool to the floating ground guard, the ground guard dislodging tool including an arcuate upper surface;

causing an actuator to move into engagement with the arcuate upper surface of the ground guard dislodging tool; and continuing to advance the actuator in at least a vertical plane to exert a dislodging force on the ground guard dislodging tool to move the floating ground guard in a downward direction relative to the frame.

11. The method of claim 10 wherein coupling the ground guard dislodging tool to the floating ground guard includes at least one of welding the ground guard dislodging tool to the floating ground guard, coupling the ground guard dislodging tool to the floating ground guard with at least one bracket, and coupling the ground guard dislodging tool to the floating ground guard with at least one fastener.

12. The method of claim 10 wherein the floating ground guard includes a generally vertical plate and at least one ski extending at substantially a right angle to the vertical plate, and coupling the ground guard dislodging tool to the floating ground guard includes engaging the ground guard dislodging tool with the at least one ski.

13. The method of claim 10 wherein the actuator includes at least a portion of a rotor support system, and said causing the actuator to move into engagement with the arcuate upper surface of the ground guard dislodging tool and said continuing to advance the actuator includes operating the at least a portion of the rotor support system to move into engagement with and exert a dislodging force on the ground guard dislodging tool.

14. The method of claim 10 wherein the rotor housing assembly further includes at least a downwardly extending plate coupled with the frame, and wherein continuing to advance the actuator to exert a dislodging force on the ground guard dislodging tool includes continuing to advance the actuator to slidably move the floating ground guard in a downward direction relative to the downwardly extending plate.

* * * * *